US005513962A

United States Patent [19]

Easton

[11] Patent Number: 5,513,962

[45] Date of Patent: May 7, 1996

[54] PNEUMATICALLY ACTUATED LUBRICANT PUMP

[75] Inventor: Richard L. Easton, Angola, Ind.

[73] Assignee: LubeCon Systems, Inc., Fremont, Mich.

[21] Appl. No.: 239,582

[22] Filed: May 9, 1994

[51] Int. Cl.[6] ..... F04B 17/00

[52] U.S. Cl. ..... 417/401; 91/234; 92/110

[58] Field of Search ..... 92/109, 110, 111, 92/112; 91/232, 234; 417/401

[56] References Cited

U.S. PATENT DOCUMENTS

| | | | |
|---|---|---|---|
| 1,694,859 | 12/1928 | Laugavoin | 92/110 |
| 1,788,298 | 1/1931 | Hottel | 92/110 |
| 2,944,521 | 7/1960 | Kibbe, Jr. | 91/234 |
| 3,380,467 | 4/1968 | Diehl et al. . | |
| 3,601,009 | 8/1971 | Burgess, Jr. | 91/234 |
| 4,541,450 | 9/1985 | Bron | 417/401 |
| 4,955,792 | 9/1990 | Skarupa . | |
| 5,235,899 | 8/1993 | Hauser | 92/110 |

FOREIGN PATENT DOCUMENTS

| | | | |
|---|---|---|---|
| 0340477 | 4/1989 | European Pat. Off. . | |
| 1312051 | 11/1962 | France . | |
| 958716 | 2/1957 | Germany . | |
| 433380 | 4/1948 | Italy | 92/110 |

*Primary Examiner*—Thomas E. Denion
*Attorney, Agent, or Firm*—Warner Norcross & Judd

[57] ABSTRACT

A pneumatically actuated lubricant pump wherein air is forced into the cylinder through a passage extending longitudinally through the piston rod. The rod is part of a piston assembly reciprocably mounted within a pump housing. The air passage extends from a lateral rod entrance through the rod and through the piston head. Air is forced into and released from the air cylinder through the passageway. In an alternative double-action embodiment, a second air flow passage extends through the pump housing alone directly to the air cylinder permitting compressed air to be alternately supplied to the opposite sides of the piston head.

8 Claims, 3 Drawing Sheets

PNEUMATICALLY ACTUATED LUBRICANT PUMP

BACKGROUND OF THE INVENTION

The present invention relates to lubricant pumps, and more particularly to pneumatically actuated lubricant pumps.

Pneumatically actuated, reciprocating lubricant pumps are well known in the industry and, as shown in FIG. 1, generally include a pneumatically driven piston assembly 30 within a pump housing 12. The head 32 of the piston assembly fits slidably within a cylinder 18 defined by the pump housing 12. In a single action pump, air is forced into the air cylinder lea behind the piston head 32 to drive the piston forward. Once the piston reaches its forward extreme (i.e. completes its pumping stroke), the air is released; and a return spring 74 returns the piston 30 backward in the air cylinder 18. In a double action pump, the return spring is omitted; and, instead, the piston is forced backward in the air cylinder by air supplied on the opposite side of the piston head. A valve system alternately supplies air ahead of and behind the piston head, causing the piston assembly to reciprocate.

In the past, air has been routed to the air cylinder 18 through the sidewall of the pump housing 12. The air flow passage 23 follows the side wall of the pump housing 12 that surrounds the air cylinder 18. As air compression builds within the air cylinder 18, significant force is exerted against the side wall of the pump housing 12. The location of the air flow passage 23 weakens the pump housing adjacent the air cylinder 18 and may lead to premature failure of the pump 10.

SUMMARY OF THE INVENTION

The aforementioned problems are overcome in the present invention wherein all air passageways within a pneumatically actuated lubricant pump are located in components other than the portion of the housing surrounding the air cylinder. This is accomplished by locating the air passageways in the piston rod and in the portion of the pump housing that does not surround the air cylinder.

More specifically, the pump includes a housing and a pumping piston reciprocably mounted therein. The piston includes a rod, and an air passageway extends longitudinally through the rod and the piston head. Additionally, the housing defines an air passageway in the rod guide portion; and air can flow between the passageway in the rod and the passageway in the rod guide. Consequently, air can be forced into and released from the air cylinder through the described passageway arrangement.

In the double action version of the pump, a second air flow passage is defined through the pump housing directly to the air cylinder so that air passageways are located on both sides of the piston head.

The present invention provides a simple, reliable, and effective construction for a pneumatically actuated pump. The location of the air passageways within the piston assembly enhances the strength of the cylinder wall. The concept is easily incorporated into both single and double action pumps.

These and other objects, advantages, and features of the invention will be more fully understood and appreciated by reference to the detailed description of the preferred embodiment and the drawings.

DETAILED DESCRIPTION OF THE PREFERRED EMBODIMENTS

Figure 2:
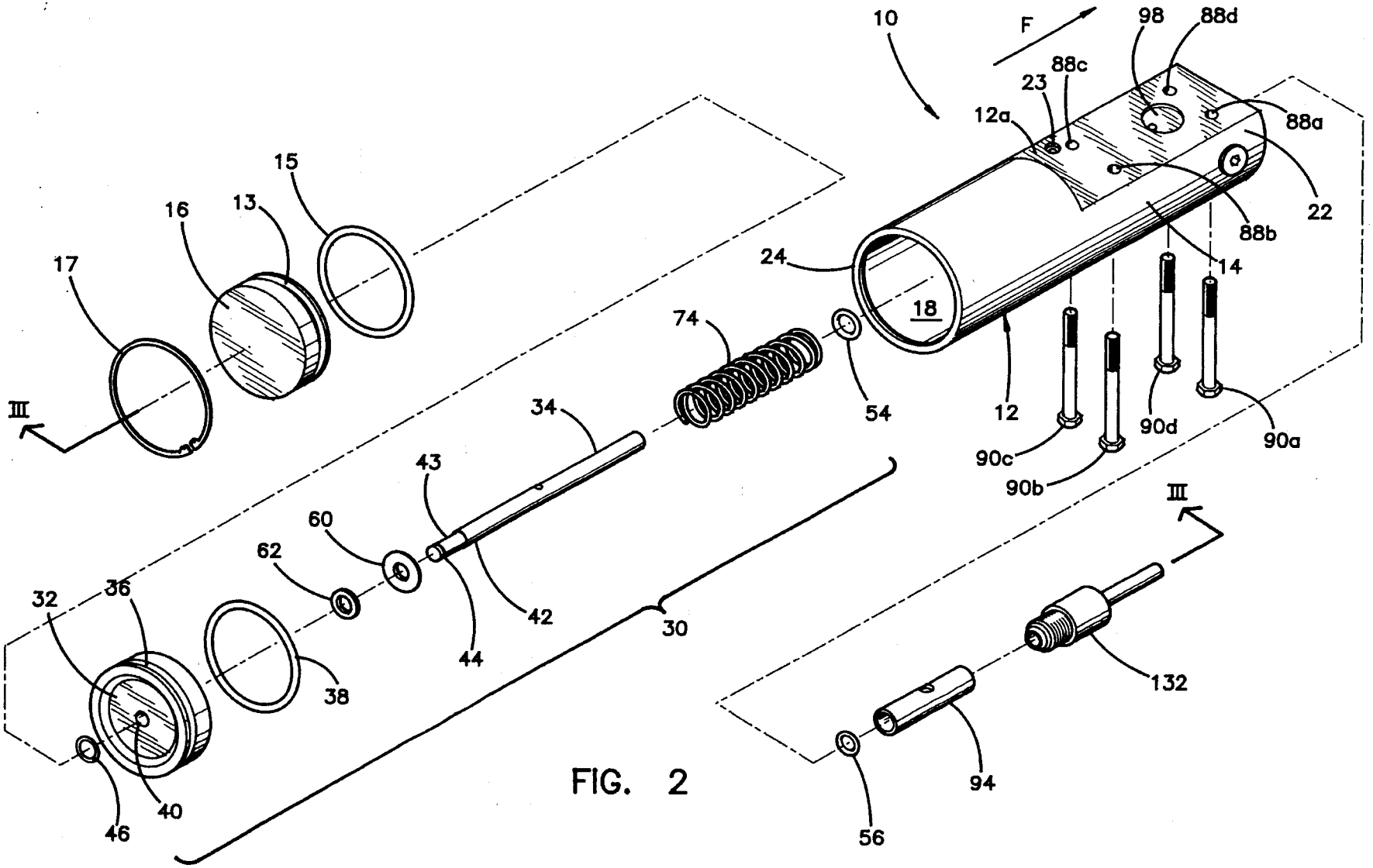
FIG. 2 is an exploded perspective view of a single action pump according to the present invention.

By way of example, and not by way of limitation, a pump constructed in accordance with a preferred embodiment of the invention is illustrated in FIG. 2 and generally designated 10. For purposes of this disclosure, the direction denoted by the arrow F will be referred to as forward; and the opposite direction will be referred to as rearward.

The single action lubricant pump 10 generally includes a piston assembly 30 that is pneumatically driven back and forth within a pump housing 12, as shown in FIG. 2. The housing 12 includes an air cylinder 18 and a rod guide 20 which slidably receive the piston assembly 30, which includes rod 34. Air is forced into the air cylinder **18*a* behind the piston head 32 to drive the piston forward. Once the piston reaches its forward extreme, a valve is actuated and the air is allowed to escape the air cylinder 18*a*, allowing a return spring 74 to return the piston assembly 30 backward in the air cylinder 18. As the piston assembly 30 travels back and forth within the air cylinder 18 it imparts reciprocating motion to rod 34 which is slidably seated within the rod guide 20. As the rod 34 travels backward, a partial vacuum is formed in the forward end of the rod guide 20. The partial vacuum draws lubricant, or other liquid, into the rod guide 20 through port 98 and passages 95*a–b*. Once the piston assembly 30 begins its forward movement, the rod 34 blocks passages 95*a–b* to prevent lubricant from flowing out of the rod guide 20 through inlet port 98. Continued forward movement of the piston assembly 30 forces the lubricant from the rod guide 20 through outlet 130 and conventional one-way valve 100**.

The pump housing 12 is generally cylindrical and includes a main body 14 having front and rear longitudinal ends 22 and 24, respectively. The housing 12 includes a flattened portion **12*a* that provides a mounting surface used in securing the pump 10 to another object. In addition, the housing 12 includes four throughbores 8*a–d* which allow the pump 10 to be bolted to another object by bolts 90*a–d*. Preferably, each of the throughbores 88*a–d* is countersunk to receive a washer 92*a–d***.

Towards its rear end 24, the housing defines a cylindrical air cylinder 18. The air cylinder 18 is concentric with the rear longitudinal end 24 of the main body 14. The forward or rod guide portion 22 of the housing 12 defines a rod guide 20 extending between the air cylinder 18 and the front end of the housing 12. Art annular recess 94 is defined toward the rear end of the rod guide 20 for seating O-ring 54. The rod guide portion 22 of the housing defines an air flow port 23 and a lubricant port 98. Both of ports 23 and 98 intersect with the rod guide 20 and extend radially through the housing 12. The forward end of the rod guide 20 includes first and second increased diameter portions 20*b* and 20*c*. The forward end or floor 70 of the cylinder defines a cylindrical spring mount concentric with both the housing and the cylinder. The rear end of the air cylinder 18 includes an annular groove 19 for receiving a snap-ring 17.

The housing 12 further includes an end closure 16 that is generally disc-shaped and fits tightly within the rear edge of the air cylinder 18. The front axial face of the end closure 16 includes a recessed portion 86*a*. An annular groove 13 extends around the circumferential face of the end closure 16 to seat O-ring 15 and provide an air tight seal between the end closure 16 and the air cylinder 18. Snap-ring 17 fits within an appropriate annular groove 19 to secure the end closure 16 within the air cylinder 18.

The piston assembly 30 is seated within the air cylinder 18 and includes a rod 34 extending through the rod guide 20. The piston head 32 is generally disc-shaped and is concentrically seated for axial movement within the air cylinder 18. The piston head 32 divides the air cylinder 18 into a first rear chamber 18*a* and a second forward chamber 18*b*. The piston head 32 includes an annular recess 36 fashioned around its circumferential face for seating an O-ring 38 to provide an air tight seal between the rear and forward chambers 18*a–b* of the air cylinder 18. The rear axial face of the piston head 32 includes a recessed portion 86*b* that mates with the recessed portion 86*a* of the end closure 16 when the two elements are in contact.

The piston head 32 further includes a concentrically disposed throughbore 40 for mounting the piston head 32 to the rod 34. The diameter of the throughbore 40 is smaller than the diameter of the rod 34 to facilitate mounting as will be discussed in more detail below.

Figure 1:
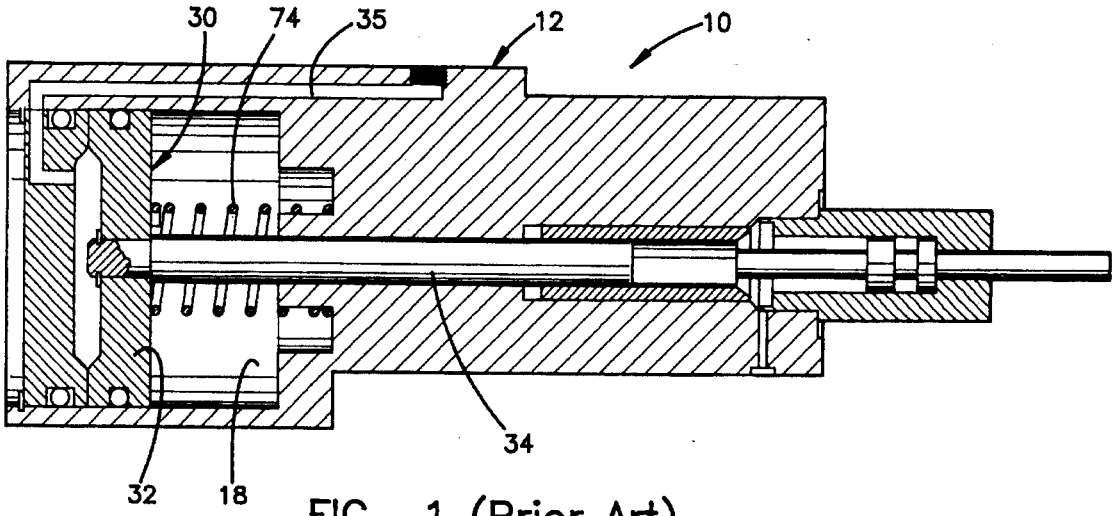
FIG. 1 (Prior Art)
FIG. 1 is a sectional view of a prior art single action pneumatically actuated lubricant pump.
Figure 3:
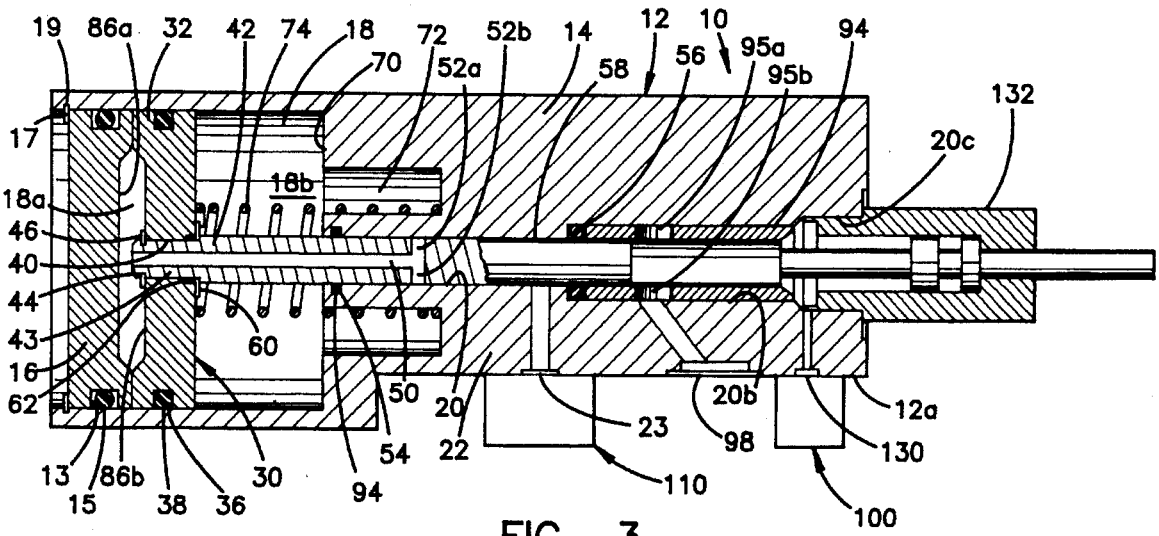
FIG. 3 is a sectional view taken along line III—III in FIG. 2 of the assembled single action pump showing the piston assembly in the rearward position.

The rod 34 is slidably supported within the rod guide 20 and includes a rear longitudinal end 42. As perhaps best illustrated in FIG. 3, an axial air passage 50 extends from the rear end 42 of the rod 34 to a central portion thereof. Ports 52*a–b* are defined through the diameter of the rod 34 at the forward end of the axial air passage 50. The rear longitudinal end 42 of the piston rod 34 has a reduced diameter portion 43 that facilitates attachment of the rod 34 to the piston head 32. The reduced diameter portion is fit through throughbore 40 of the piston head 32. An annular groove 44 at the rear longitudinal end of the reduced diameter portion 43 receives a snap-ring 46 to secure the piston head 32 to the piston rod 34. A washer 60 and O-ring 62 on the reduced diameter portion 43 create an air tight seal between the piston head 32 and piston rod 34.

A sleeve 94 fits within the first increased diameter portion 20*b* of the rod guide 20. Sleeve 94 is of sufficient diameter to allow the rod 34 to reciprocate therein and includes lubricant passages 95*a* and 95*b*.

Preferrably, a stroke adjuster 132 is threadedly secured within the second increased diameter portion 20*c* of the rod guide 20. The stroke adjuster 132 is adjustable to control the length of the stroke of the piston assembly 30. Consequently, providing a way to control the displacement of the pump. Alternatively, the stroke adjuster 132 can be replaced by a threaded plug (not shown) which does not provide for control of the pump displacement.

In addition, a one-way valve 100 is secured to inlet pork 98. One-way valve 100 is a conventional one-way valve, the operation of which is well known to those of ordinary skill in the art.

O-ring 54 within recess 94 and O-ring 56 interposed between sleeve 94 and the rear end wall of the first increased diameter portion 20*b* of the rod guide 20 provide sealing. O-rings 54 and 56 entrap ports 52*a–b* and port 23 within an air tight chamber 58 along the entire range of movement of the rod 34.

OPERATION

Figure 4:
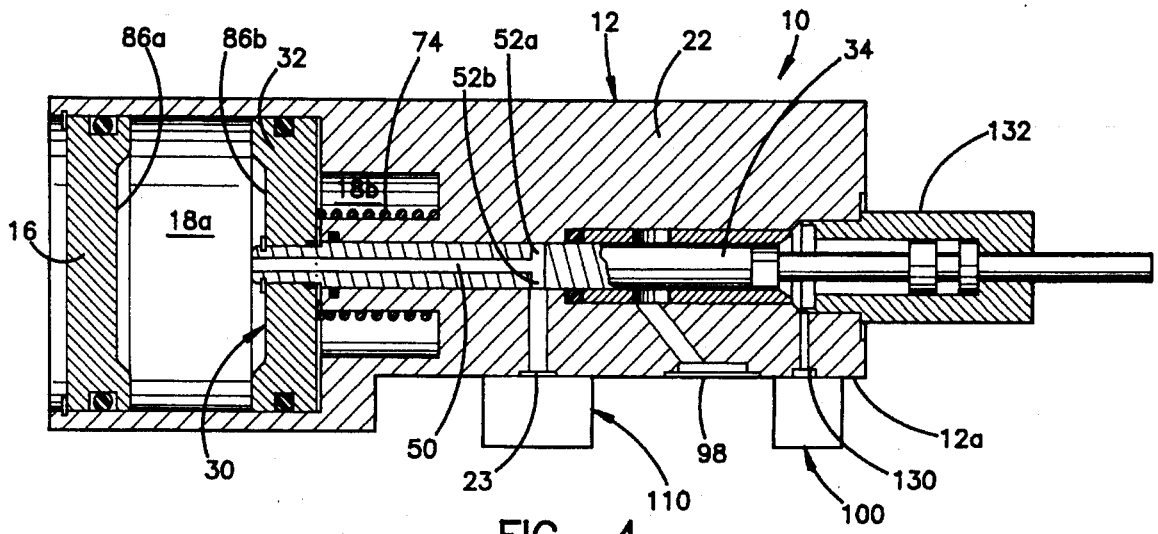
FIG. 4 is a sectional view similar to FIG. 3 showing the piston assembly in the forward position.

In operation, a supply of compressed air (not shown) is connected to port 23 through a three-way valve 110. In a first position (FIG. 3), the valve interconnects the supply of compressed air and the pump, allowing air to pass into the pump 10. In a second position (FIG. 4), the valve vents the pump 10 to atmosphere.

As air is supplied to the pump 10, it passes in the air flow port 23 and into chamber 58 which surrounds the rod 34. Air flows into the air passage 50 in the center of the rod 34 through ports 52*a–b* and into the rear chamber 18*a* of the air cylinder 18. As the air pressure builds in the rear chamber 18*a*, return spring 74 is compressed and the piston assembly 30 is driven forward. Air is continually supplied to the rear chamber 18*a* until the piston assembly 30 has reached its forward extreme (See FIG. 4). At that time, the valve is actuated to allow the air to flow out of the pump 10 following the above described air flow passage in reverse. When air is released from the pump 10, the return spring 74 returns the piston assembly 30 to a position against the rear of the air cylinder 18. The force in the compressed return spring 74 is sufficient to expel the air in rear chamber 18*a* and return the piston assembly 30 to its rear extreme. The cycle continues, thereby providing a reciprocating motion of the piston assembly 30. As discussed above, the reciprocating motion of the rod is translated into a pumping action through a conventional one way valve 100 secured to outlet 130.

ALTERNATIVE EMBODIMENT, DOUBLE-ACTION PUMP

Figure 5:
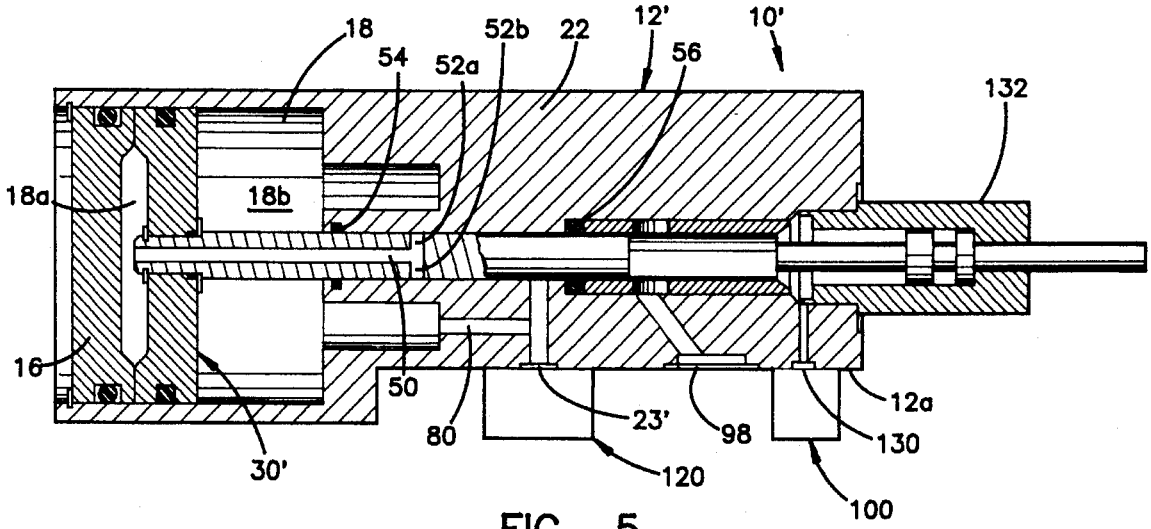
FIG. 5 is a sectional view similar to FIG. 3 of an alternative embodiment double action pump showing the piston assembly in the rearward position.

An alternative embodiment of the present invention is illustrated in FIG. 5 and generally designated 10'. This embodiment is generally identical to the preferred embodiment described above. However, this embodiment provides a double action pneumatically actuated pump in which the return spring is omitted; and compressed air is employed to return the piston assembly 30' to its rear extreme. In this embodiment, a second air passage 80 is defined in the main body 14 of the pump housing 12. The second passage 80 extends axially from the forward chamber 18*b* of the air cylinder 18 and communicates with radially defined air flow port, which is not visible in FIGS. 5 or 6 because it is aligned with port 23'.

A supply of compressed air is connected to the air flow ports through a conventional valving assembly 120. The valving assembly alternates between a first position (see FIG. 5) in which air is supplied to the rear chamber 18*a* and allowed to escape from the forward chamber 18*b*, and a second position (see FIG. 6) in which air is supplied to the forward chamber 18*b* and allowed to escape from the rear chamber 18*a*.

Figure 6:
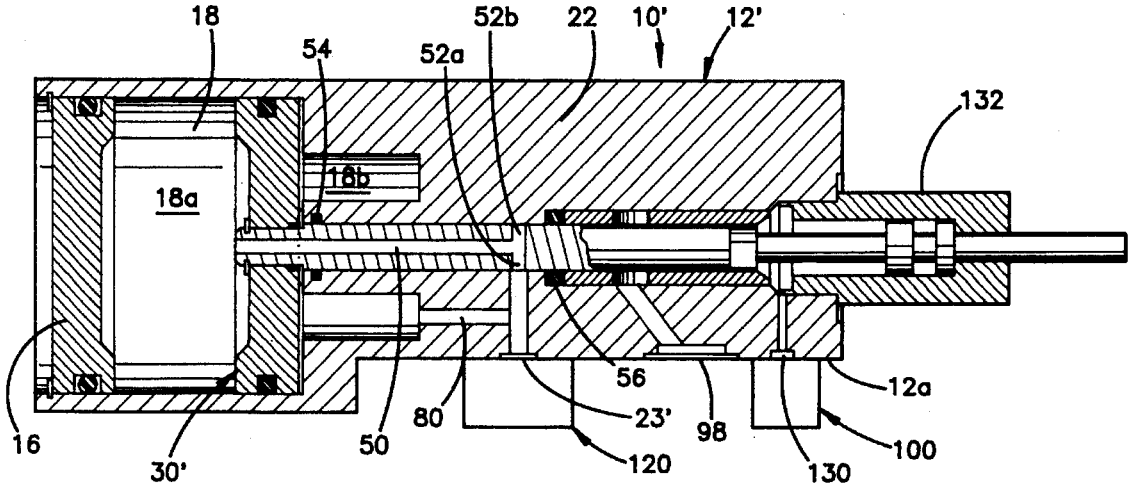
FIG. 6 is a sectional view similar to FIG. 5 showing the piston assembly in the forward position.

During operation of the alternative embodiment, air is supplied to the rear chamber 18*a* through air flow port 23' to drive the piston assembly 30 to its forward extreme (See FIG. 6). Simultaneously, air escapes from the forward chamber 18*b* through passage 80. Once the piston assembly 30 reaches its forward extreme, the valve system is actuated and air is supplied to the forward chamber 18*b* through the second passage 80. The pressure in the forward chamber 18*b* drives the piston assembly 30 rearward thereby expelling the air contained in the rear chamber 18*a* through air flow port 23'. The cycle continues, thereby providing reciprocating motion of the rod 34.

The above descriptions are those of preferred embodiments of the invention. Various alterations and changes can be made without departing from the spirit and broader aspects of the invention as set forth in the appended claims, which are to be interpreted in accordance with the principles of patent law, including the doctrine of equivalents.

The embodiments of the invention in which an exclusive property or privilege is claimed are defined as follows:

1. A reciprocating liquid pump, comprising:

a pump housing defining a cylinder, an air flow port, a liquid inlet, a liquid outlet, and a rod guide;

a rod having first and second opposite ends and mounted for reciprocating motion within said rod guide;

a piston assembly including a piston head affixed to said first end of said rod, said piston head mounted for reciprocating motion within said cylinder, said piston assembly defining an air flow passage through said piston head and longitudinally through a portion of said rod, said air passage allowing air to flow from said air flow port into said cylinder through said piston assembly thereby forcing said piston assembly to move forwardly and out of said cylinder through said piston assembly and said air flow port thereby allowing said piston assembly to move rearwardly; and a one-way valve operatively connected to said liquid outlet, said rearward movement of said piston assembly drawing fluid into said pump through said liquid inlet, said forward movement of said piston assembly forcing said fluid out of said pump through said liquid outlet, said one-way valve causing the liquid to flow from said fluid inlet to said fluid outlet.

2. The liquid pump of claim 1, wherein said rod includes a central portion defining a lateral entrance for said air passageway; and further comprising sealing means for creating an air tight chamber in said rod guide around said central portion and said lateral air passageway entrance of said rod.

3. The liquid pump of claim 2, further comprising a return spring biasing said piston assembly toward one end of said cylinder.

4. The liquid pump of claim 2, further comprising a second air passage allowing air to flow into and out of said cylinder, said second air passage located solely within said housing.

5. A pneumatically actuated liquid pump, comprising:

a pump housing having an air cylinder, an air flow port, a liquid inlet, a liquid outlet, and a rod guide defined therein, said rod guide extending in axial alignment from said air cylinder;

a piston head slidably received within said air cylinder, said piston head dividing said air cylinder into first and second chambers whose relative volumes vary depending on the position of said piston head;

a rod having first and second longitudinal ends, said first end mounted to said piston head, said second end slidably received within said rod guide and located within said rod guide at all positions of said rod, said rod defining an air passage allowing air to flow from said air flow port through said rod into said first chamber causing said rod to move forwardly in said rod guide and out of said first chamber and through said rod and said air flow port to allow said rod to move rearwardly in said rod guide; and a one-way valve operatively connected to said liquid outlet, said rearward movement of said rod drawing fluid into said pump through said liquid inlet, said forward movement of said piston assembly forcing said fluid out of said pump through said liquid outlet, said one-way valve causing said fluid to flow from said fluid inlet to said fluid outlet.

6. The pump of claim 5, wherein said rod includes a central portion; further comprising:

sealing means for creating an air tight chamber in said rod guide around said central portion of said rod, wherein said air passage includes an axial flow passage defined within said rod from said first end to said central portion, said air passage further including a port extending radially through said central portion of said rod, whereby said axial flow passage is in communication with said air tight chamber in said rod guide.

7. The pump of claim 6, further comprising a return spring within said second chamber of said air cylinder biasing said piston toward one end of said cylinder.

8. The pump of claim 6, wherein said housing alone defines a second air flow passage allowing air to flow into and out of said second chamber.

* * * * *